US010036086B2

(12) United States Patent
Teramoto et al.

(10) Patent No.: US 10,036,086 B2
(45) Date of Patent: Jul. 31, 2018

(54) NON-HEAT TREATED STEEL

(71) Applicant: NIPPON STEEL & SUMITOMO METAL CORPORATION, Tokyo (JP)

(72) Inventors: Shinya Teramoto, Tokyo (JP); Manabu Kubota, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/351,597

(22) PCT Filed: Apr. 30, 2013

(86) PCT No.: PCT/JP2013/062551
§ 371 (c)(1),
(2) Date: Apr. 14, 2014

(87) PCT Pub. No.: WO2014/178099
PCT Pub. Date: Nov. 6, 2014

(65) Prior Publication Data

US 2015/0218685 A1 Aug. 6, 2015

(51) Int. Cl.

| | |
|---|---|
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/18*** | (2006.01) |
| ***C22C 38/24*** | (2006.01) |
| ***C22C 38/26*** | (2006.01) |
| ***C22C 38/28*** | (2006.01) |

(52) U.S. Cl.
CPC ..... *C22C 38/60* (2013.01); *C22C 38/00* (2013.01); *C22C 38/001* (2013.01); *C22C 38/002* (2013.01); *C22C 38/02* (2013.01); *C22C 38/04* (2013.01); *C22C 38/12* (2013.01); *C22C 38/14* (2013.01); *C22C 38/18* (2013.01); *C22C 38/24* (2013.01); *C22C 38/26* (2013.01); *C22C 38/28* (2013.01); *C21D 2211/004* (2013.01)

(58) Field of Classification Search
CPC ..... C22C 38/02
USPC ..... 420/84
See application file for complete search history.

(56) References Cited

U.S. PATENT DOCUMENTS

| | | | |
|---|---|---|---|
| 6,143,242 | A | 11/2000 | Takada et al. |
| 6,671,955 | B2 | 1/2004 | Hugler |

FOREIGN PATENT DOCUMENTS

| | | | |
|---|---|---|---|
| CN | 102108472 | A | 6/2011 |
| EP | 2 246 451 | A1 | 11/2010 |
| FR | 2 774 098 | A1 | 7/1999 |
| JP | 3355132 | B2 | 12/2002 |
| JP | 2003-286545 | A | 10/2003 |
| JP | 2004-225073 | A | 8/2004 |
| JP | 3637375 | B2 | 4/2005 |
| JP | 3671688 | B2 | 7/2005 |
| JP | 3756307 | B2 | 3/2006 |
| JP | 3988661 | B2 | 10/2007 |
| JP | 4086734 | B2 | 5/2008 |
| JP | 4268194 | B2 | 5/2009 |
| JP | 4314851 | B2 | 8/2009 |
| JP | 2010-77488 | A | 4/2010 |
| JP | 2010-180473 | A | 8/2010 |
| JP | 4705740 | B2 | 6/2011 |
| WO | WO 2009/107282 | A1 | 9/2009 |

OTHER PUBLICATIONS

Machine translation of JP 2004-225073 (Japanese document published Aug. 12, 2004).*
Machine translation of FR2774098A1 (French document published Jul. 30, 1999).*
Machine translation of CN102108472A (Chinese document published Jun. 29, 2011).*
International Search Report Issued in PCT/JP2013/062551, dated Jul. 30, 2013.
Japanese Office Action 2013-548682 dated Jan. 7, 2014.
PCT/ISA/237—Issued in PCT/JP2013/062551, mailed on Jul. 30, 2013.
Chinese Office Action dated Aug. 5, 2015, issued in Chinese Patent Application No. 201380003849.8 (with English translation).
Author Unknown, "Overseas Low Alloy Steel," Alloy Steel 2, Central Iron and Steel Research Institute Press, vol. 4, Dec. 31, 1987, p. 115 (3 pages total), with a partial English translation thereof.
Chen, Ed., "Fundamentals of Metal Weldability," China Machine Press, 3rd Print, Nov. 30, 1984, p. 98 (3 pages total), with a partial English translation thereof.
Chinese Notice of Reexamination for counterpart Chinese Application No. 201380003849.8, dated Mar. 16, 2017, with an English translation.
Fu et al., Eds., "Collections of Research Findings of Steel," 1st Edition, Liaoning Science and Technology Publishing House, Nov. 1993, pp. 96-97 (4 pages total), with a partial English translation thereof.
Ma, Ed., "Principles of Metal Solidification," Metallurgical Industry Press, May 31, 2008, p. 301 (3 pages total), with a partial English translation thereof.

* cited by examiner

*Primary Examiner* — Christopher Kessler
(74) *Attorney, Agent, or Firm* — Birch, Stewart, Kolasch & Birch, LLP

(57) ABSTRACT

A non-heat treated steel according to the present invention includes, as steel composition, by mass %, 0.20 to 0.60% of C, 0.50 to 2.0% of Si, 0.20 to 2.0% of Mn, 0.010 to 0.15% of P, 0.010 to 0.15% of S, 0.10 to 0.50% of V. 0.002 to 0.02% of N, and a balance consisting of Fe and impurities, in which, when a ratio of a maximum value of a V content in the steel to an average value of the V content in the steel in a cross section of the steel is defined as a segregation ratio of V, the segregation ratio of V is 1.0 or more and less than 3.0.

6 Claims, 2 Drawing Sheets

NON-HEAT TREATED STEEL

TECHNICAL FIELD

The present invention relates to a non-heat treated steel which is capable of omitting a heat treatment including quenching and tempering and which is performed immediately after hot forging for forming the steel into a steel component, and more particularly to a material for the steel component which is used with fracture splitting.

BACKGROUND ART

Recently, a non-hear treated steel to be hot-forged (hereinafter, referred to as a non-heat treated steel) in which heat treatments can be omitted is applied to a forged component for a vehicle engine and a forged component for a vehicle suspension. The chemical composition of the non-heat treated steel is designed to realize excellent mechanical properties even when the non-heat treated steel is as air-cooled or as forced-air-cooled after hot forging, that is, even when the heat treatments including quenching and tempering according to the related art are omitted.

As one of the components to which the non-heat treated steel is widely applied, there is a connecting rod (hereinafter, called a conrod) for an engine. The conrod is a component which converts a reciprocating motion of a piston in the engine into a rotating motion of a crankshaft to transmit power and is composed of two pans, i.e. a cap and a rod. The conrod is mounted to the crankshaft by interposing the crankshaft between the cap and the rod and fastening them with bolts. Hitherto, the conrod is manufactured by separately forging the cap and the rod or mechanically cutting a product forged to have a shape in which the cap and the rod are integrated, and thereafter processing joint surfaces of the cap and the rod by machining with high accuracy. In addition, in many cases, pin-cutting is performed to prevent the joint surfaces from misalignment. Therefore, the processing becomes more complex, and thus there is a problem in that the manufacturing costs are increased.

Therefore, in recent years, a method including hot forging a steel to form the steel into a shape in which a cap and a rod are integrated, notching the inside of a large end portion of the formed product, cold fracture splitting the formed product into the cap and the rod by applying an impact tensile stress to the formed product, and mounting the cap and the rod to a crankshaft using the fractured surfaces thereof as joint surfaces is employed. In this method, machining of the joint surfaces is unnecessary. In addition, pin-cutting to prevent misalignment can be omitted as necessary using irregularities of the fractured surfaces. Therefore, the processing cost of components can be reduced. Moreover, since the area of the joint surfaces can be reduced by omitting pins, it is possible to achieve reductions in the size and weight of the conrod itself.

In Europe and USA where such fracture split conrod is widely supplied, C70S6 in the DIN standards is supplied as a steel for the fracture split conrods. This is a high carbon non-heat treated steel containing 0.7 weight % of carbon, and in order to suppress changes in dimensions during fracture splitting, almost the entire structure thereof is a pearlite structure having low ductility and low toughness. An amount of plastic deformation of C70S6 in the vicinity of a fractured surface at the time of fracture is small and thus C70S6 has excellent fracture separability. On the other hand, C70S6 has a coarse structure compared to a ferrite-pearlite structure of a medium carbon non-heat treated steel which is a current steel for a conrod and thus has a low yield ratio (i.e. yield strength/tensile strength). Therefore, there is a problem in that C70S6 cannot be applied to a high strength conrod which requires high buckling strength.

In order to increase the yield ratio, it is necessary to control an amount of carbon low and to increase a ferrite fraction. However, when the ferrite fraction is increased, ductility and toughness are enhanced, and thus the amount of plastic deformation in the vicinity of the fractured surface during fracture splitting is increased, resulting in an increase in the amount of deformation of the inside diameter of the large end portion of the conrod. Therefore, there is a problem in that the fracture separability is degraded.

In order to solve the problems, a medium carbon non-heat treated steels having excellent fracture separability are proposed. For example, in Patent Documents 1 and 2, a technique of adding a large amount of an embrittling element such as Si or P in order to degrade ductility and toughness of a material itself so as to improve fracture separability is described. In Patent Documents 3 and 4, a technique of degrading the ductility and toughness of ferrite using precipitation strengthening of second phase particles so as to improve fracture separability is described. In Patent Documents 5 to 8, a technique of controlling the form of Mn sulfides so as to improve fracture separability is described. In Patent Document 9, a technique of heating a steel to an ultra-high temperature close to a solidus line or a liquidus line in order to significantly coarsen the structure of the steel so as to improve fracture separability is described. However, in the techniques, while the amount of deformation of the fractured surface obtained by the fracture splitting is small, the material becomes brittle, and thus chipping occurs during fracture splitting or during engaging the fractured surfaces with each other. Chips of the fractured surfaces cause misalignment in a position during the engagement between the fractured surfaces, and thus there may be a problem in which the engagement cannot be performed with high-accuracy.

PRIOR ART DOCUMENT

Patent Document

[Patent Document 1] Japanese Patent (Granted) Publication No. 3637375

[Patent Document 2] Japanese Patent (Granted) Publication No. 3756307

[Patent Document 3] Japanese Patent (Granted) Publication No. 3355132

[Patent Document 4] Japanese Patent (Granted) Publication No. 3988661

[Patent Document 5] Japanese Patent (Granted) Publication No. 4314851

[Patent Document 6] Japanese Patent (Granted) Publication No. 3671688

[Patent Document 7] Japanese Patent (Granted) Publication No. 4268194

[Patent Document 8] PCT International Publication No. WO2009/107282

[Patent Document 9] Japanese Patent (Granted) Publication No. 4086734

[Patent Document 10] Japanese Patent (Granted) Publication No. 4705740

DISCLOSURE OF THE INVENTION

Problems to be Solved by the Invention

In consideration of the foregoing circumstances, an object of the present invention is to provide a non-heat treated steel in which an amount of plastic deformation in the vicinity of a fractured surface at the time of fracture is small, chipping of the fractured surface is suppressed, and fracture separability is excellent.

Means for Solving the Problem

The inventors have found that an amount of deformation during fracture splitting is reduced by including a larger amount of V than that of the related art and chips of a fractured surface after the fracture splitting can be reduced by reducing segregation of V in a steel, and have completed the present invention. The subject matter of the present invention is as described below.

(a) A non-heat treated steel according to an aspect of the present invention includes, as steel composition, by mass %, 0.20 to 0.60% of C, 0.50 to 2.0% of Si, 0.20 to 2.0% of Mn, 0.010 to 0.15% of P, 0.010 to 0.15% of S, 0.10 to 0.50% of V, 0.002 to 0.02% of N, and a balance consisting of Fe and impurities, in which when a ratio of a maximum value of a V content in the steel to an average value of the V content in the steel in a cross section of the steel is defined as a segregation ratio of V, the segregation ratio of V is 1.0 or more and less than 3.0.

(b) The non-heat treated steel described in (a) may further include at least one of, by mass %, 0.005% or less of Ca, 0.005% or less of Mg, and 0.005% or less of Zr.

(c) The non-heat treated steel described in (a) or (b) may further include at least one of, by mass %, 0.25% or less of Cr, 0.10% or less of Ti, and 0.05% or less of Nb.

Effects of the Invention

The non-heat treated steel according to the aspect of the present invention has excellent fracture separability in which an amount of plastic deformation in the vicinity of a fractured surface is small and chips of the fractured surface are small when fracture splitting is performed after performing air-cooling or forced-air-cooling after hot forging. Due to the characteristics in which the amount of plastic deformation of the fractured surface is small and furthermore chips are small, the fractured surfaces can be engaged with each other with high-accuracy without misalignment in position during the engagement between the fractured surfaces, thereby increasing the yield in component production. In addition, due to the characteristics, a process of eliminating the chips can be omitted, which results in a reduction in the manufacturing cost. This is extremely effective in the industry.

EMBODIMENTS OF THE INVENTION

Figure 1:
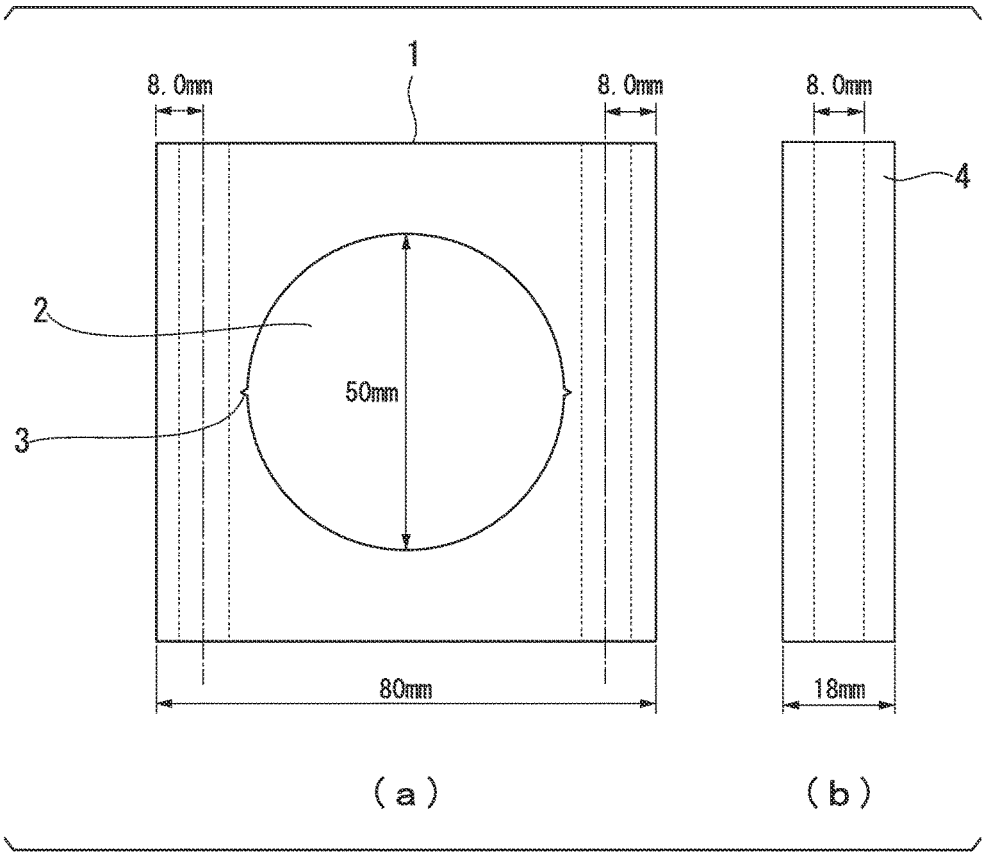
FIG. 1 is a diagram illustrating a specimen having a shape corresponding to a large end portion of a conrod used in a fracture separability evaluation test, in which (a) is a plan view and (b) is a side view.

The inventors have intensively researched various factors which influence an amount of plastic deformation in the vicinity of a fractured surface and which influence chipping of the fractured surface after fracture splitting and have obtained the following knowledge.

(1) By including a large amount of V, an amount of plastic deformation in the vicinity of the fractured surface after the fracture splitting can be reduced. During cooling after hot forging, V carbides and V carbonitrides precipitate in a ferrite structure and strengthen the ferrite with precipitation strengthening. Ductility and toughness are reduced by strengthening the ferrite. Due to sufficient reductions in ductility and toughness, the amount of deformation after the fracture splitting is reduced. However, generally, the fractured surface becomes brittle due to the reductions in ductility and toughness, and accordingly, there may be cases where chipping of the fractured surface occurs.

(2) By reducing a segregation of V in a steel, such chips of the fractured surface are reduced. The microstructure of the steel becomes inhomogeneous by including a large amount of V, since V is significantly segregated, the amount of V becomes irregular, and thus a ferrite transformation start temperature in the steel becomes irregular. When the steel is subjected to the fracture splitting, the inhomogeneous structure significantly changes the crack propagation direction and branches the crack to generate sub-cracking, which result in a large amount of chips.

In the present invention, "segregation of V" is defined as "segregation ratio of V". The "segregation ratio of V" refers to a ratio of a maximum value of V content in the steel to an average value of V content in the steel (i.e. maximum value/average value) in a cross-section of the steel product.

Hereinafter, the reason for limiting an amount of each of elements contained in a steel according to this embodiment will be described. Here, "%" regarding a chemical compositions means "mass %".

C: 0.20 to 0.60%

C has an effect of ensuring tensile strength of a component and an effect of realizing good fracture separability by increasing a volume fraction of pearlite (i.e. pearlite fraction), the pearlite having low ductility and low toughness, to reduce an amount of plastic deformation in the vicinity of the fractured surface at the time of fracture. In order to obtain the effects, the lower limit of the amount of C needs to be 0.20%. The lower limit of the amount of C is preferably 0.25%, and is more preferably 0.30%. In terms of improving fracture separability, the upper limit of the amount of C does not need to be specified. However, when C is excessively contained, the pearlite fraction becomes excessive, and the structure is coarsened, resulting in a reduction in yield ratio, which is not preferable in a case where the steel is applied to a high strength conrod that requires buckling strength. Therefore, the upper limit of the amount of C is 0.60%. The upper limit of the amount of C is preferably 0.50%, and is more preferably 0.48%.

Si: 0.50 to 2.0%

Si strengthens the ferrite through solid solution strengthening, and reduces ductility and toughness. The reduction in ductility and toughness reduces the amount of plastic deformation in the vicinity of the fractured surface at the time of the fracture and thus has an effect of realizing good fracture separability. In order to obtain this effect, the lower limit of the amount of Si needs to be 0.50%. When Si is excessively contained, the ferrite fraction may become excessive, and thus there may be cases where the fracture separability of the steel is degraded. Therefore, the upper limit of the amount of Si is 2.0%/o. The upper limit of the amount of Si is preferably 1.5%, and is more preferably 1.25%.

Mn: 0.20 to 2.0%

Mn strengthens the ferrite through solid solution strengthening, and reduces ductility and toughness. The reduction in ductility and toughness reduces the amount of plastic deformation in the vicinity of the fractured surface at the time of the fracture and thus has an effect of realizing good fracture separability. In addition, Mn combines to S and forms Mn sulfide. When the steel is subjected to the fracture splitting, the crack propagates along the Mn sulfide that extends along a rolling direction. Therefore, including Mn has an effect of enlarging irregularities of the fractured surface and thus preventing misalignment in position during engagement between the fractured surfaces. In order to obtain the effects, the lower limit of the amount of Mn needs to be 0.20%. The lower limit of the amount of Mn is preferably 0.30%, and more preferably 0.45%. When Mn is excessively contained, a lamellar spacing of the pearlite is reduced, and the ductility and toughness of the pearlite is increased. Therefore, the amount of plastic deformation in the vicinity of the fractured surface at the time of the fracture is increased, and thus fracture separability is degraded. Moreover, when Mn is excessively contained, a bainite structure is likely to be generated, and thus there may be cases where fracture separability is significantly degraded. Accordingly, the upper limit of the amount of Mn is 2.0%. The upper limit of the amount of Mn is preferably 1.5%, is more preferably 1.2%, and is even more preferably 1.0%.

P: 0.010 to 0.15%

P reduces the ductility and toughness of the ferrite and the pearlite. The reduction in ductility and toughness reduces the amount of plastic deformation in the vicinity of the fractured surface at the time of the fracture and thus has an effect of realizing good fracture separability. In order to obtain this effect, the lower limit of the amount of P needs to be 0.010%. The lower limit of the amount of P is preferably 0.030%. When P is excessively contained, there may be cases where hot ductility is degraded and thus cracking and defects are likely to occur during hot working. Therefore, the upper limit of the amount of P is 0.15%. The upper limit of the amount of P is preferably 0.10%, and is more preferably 0.070%.

S: 0.010 to 0.15%

S is bonded to Mn and forms Mn sulfides. When the steel is subjected to the fracture splitting, the crack propagates along the Mn sulfide that extends along the rolling direction. Therefore, including S enlarges irregularities of the fractured surface and thus has an effect of preventing misalignment in position during engagement between the fractured surfaces. In order to obtain this effect, the lower limit of the amount of S needs to be 0.010%. When S is excessively contained, the amount of plastic deformation in the vicinity of the fractured surface during the fracture splitting is increased, and thus there may be cases where fracture separability is degraded. In addition, when S is excessively contained, there may be cases where hot ductility is degraded and thus cracking or defects are likely to occur during hot working. Therefore, the upper limit of the amount of S is 0.15%. The upper limit of the amount of S is preferably 0.12%, and is more preferably 0.10%.

V: 0.10 to 0.50%

V is an important element in the steel according to this embodiment. V reduces ductility and toughness by forming mainly carbides or carbonitrides during cooling after the hot forging to strengthen the ferrite. The reduction in ductility and toughness reduces the amount of plastic deformation in the vicinity of the fractured surface at the time of the fracture and enables the steel to have good fracture separability. In addition, V has an effect of increasing the yield ratio of the steel by the precipitation strengthening of carbides or carbonitrides. In order to obtain this effect, the lower limit of the amount of V needs to be 0.10%. The lower limit of the amount of V is preferably 0.15%, and is more preferably 0.20%. On the other hand, even when V is excessively contained, the effect is saturated, and thus the upper limit of the amount of V is 0.50%. The upper limit of the amount of V is preferably 0.35%.

N: 0.002 to 0.02%

N acts as a transformation nucleus of the ferrite by forming mainly V nitrides or V carbonitrides during cooling after hot forging to accelerate ferrite transformation. Accordingly, N has an effect of suppressing generation of the bainite structure that significantly harms the fracture separability of the steel. In order to obtain this effect, the lower limit of the amount of N needs to be 0.002%. When N is excessively contained, there may be cases where hot ductility is degraded and thus cracking and defects are likely to occur during hot working. Therefore, the upper limit of the amount of N is 0.02%. The upper limit of the amount of N is preferably 0.01%.

At least one of Ca: 0.005% or less, Mg: 0.005% or less, and Zr: 0.005%

All of Ca, Mg, and Zr form oxides to become crystallization nuclei or precipitation nuclei of Mn sulfides, and thus uniformly and finely disperse the Mn sulfide. The Mn sulfide has an effect of becoming propagation paths of cracks during the fracture splitting to reduce the amount of plastic deformation in the vicinity of the fractured surface and to enhance fracture separability. When Ca, Mg, and Zr are excessively contained, the effect is saturated, and thus the upper limit of each of the amounts of Ca, Mg, and Zr is 0.005%. In order to sufficiently exhibit the effect, the lower limit of each of the amounts of Ca, Mg, and Zr is preferably 0.0005%.

The steel according to this embodiment may further contain at least one of 0.25% or less of Cr, 0.10% or less of Ti, and 0.05% or less of Nb as necessary.

Cr: 0.25% or less

Similarly to Mn, Cr strengthens the ferrite through solid solution strengthening, and reduces ductility and toughness. The reduction in ductility and toughness reduces the amount of plastic deformation in the vicinity of the fractured surface at the time of the fracture and thus has an effect of obtaining good fracture separability. However, when Cr is excessively contained, a lamellar spacing of the pearlite decreases, and the ductility and toughness of the pearlite are increased. Therefore, the amount of plastic deformation in the vicinity of the fractured surface at the time of the fracture is increased, and thus fracture separability is degraded. In addition, when Cr is excessively contained, a bainite structure is likely to be generated, and thus there may be cases where fracture separability is significantly degraded. Accordingly, in a case where Cr is contained in order to obtain the above-described effects, the amount of Cr is 0.25% or less. The upper limit of the amount of Cr is preferably 0.15%. In order to sufficiently exhibit the effect of Cr, the lower limit of the amount of Cr is preferably 0.01%.

Ti: 0.10% or less

Ti forms mainly carbides or carbonitrides during cooling after hot forging, strengthens the ferrite through precipitation strengthening, and reduces ductility and toughness. The reduction in ductility and toughness has an effect of reducing the amount of plastic deformation in the vicinity of the fractured surface at the time of the fracture to obtain good fracture separability. However, when Ti is excessively contained, the effect is saturated. Therefore, in a case where Ti is contained in order to obtain the above-described effect, the upper limit of the amount of Ti is 0.10%. In order to sufficiently exhibit the effect of Ti, the lower limit of the amount of Ti is preferably 0.005%. An appropriate range of the amount of Ti is 0.010 to 0.030%.

Nb: 0.05% or less

Nb forms mainly carbides or carbonitrides during cooling after hot forging and strengthens the ferrite through precipitation strengthening to reduce ductility and toughness. The reduction in ductility and toughness has an effect of reducing the amount of plastic deformation in the vicinity of the fractured surface at the time of the fracture to obtain good fracture separability. However, when Nb is excessively contained, the effect is saturated. Therefore, in a case where Nb is contained in order to obtain the above-described effect, the upper limit of the amount of Nb is 0.05%. In order to sufficiently exhibit the effect of Nb, the lower limit of the amount of Nb is preferably 0.005%. An appropriate range of the amount of Nb is 0.010 to 0.030%.

The balance of the steel according to this embodiment includes iron and impurities. The impurities are referred to as those incorporated from raw materials such as ore or scraps and from a manufacturing environment. Moreover, the steel according to this embodiment may contain Te, Zn, Sn, and the like in addition to the above-described elements in a range that does not harm the effects of the steel according to this embodiment.

Next, the reason for the segregation ratio of V of the steel being 1.0 or more and less than 3.0 will be described.

When a large amount of V is contained, the steel has low ductility and low toughness, and the amount of plastic deformation in the vicinity of the fractured surface during the fracture splitting is reduced. On the other hand, when a large amount of V is contained, the fractured surface becomes brittle and the chipping is likely to occur. When a large amount of V is contained, segregation of V significantly occurs and thus the structure after the hot forging becomes inhomogeneous. This significantly changes the propagation direction of cracks and blanches the cracks to generate sub-cracking during the fracture splitting to the steel. This results in a large amount of chips. The inventors have researched the relationship between the segregation ratio of V and the chipping of the fractured surface.

A steel having a composition including 0.38% (mass %, and the same applies to the following) of C, 0.88% of Si, 0.69% of Mn, 0.054% of P, 0.073% of S, 0.30% of V, 0.0104% of N, and the balance consisting of Fe and the impurities was melted in a converter to be manufactured by continuous casting, and was subjected to hot rolling to have a steel bar shape having a diameter of 56 mm. At this time, a plurality of steel products with varying segregation ratios of V were prepared by adjusting whether or not to perform electromagnetic stirring in a die during the continuous casting, a degree of superheating molten steel in a tundish (13 to 52° C.), and a rolling reduction gradient (0.0 to 3.0 mm/m) during light rolling reduction of a final solidification portion.

The segregation ratio of V is an index which represents a degree of the segregation of V. Here, by using an electron probe microanalyzer (EPMA), line analysis was performed on a cross-section perpendicular to a hot rolling direction of the steel bar having a diameter of 56 mm in a radial direction from the surface to the center and from the center to the surface, the maximum value and the average value of the V content were measured, and the ratio (i.e. the maximum value/the average value of the V concentration) thereof was calculated. Therefore, the value of the segregation ratio is high when the segregation is significant, and the value of the segregation ratio is 1.0 when no segregation occurs.

In order to evaluate the chipping of the fractured surface, a specimen corresponding to a forged conrod was manufactured by hot forging. Specifically, a steel bar having a diameter of 56 mm and a length of 100 mm was heated at 1250° C., was thereafter forged in a direction perpendicular to the lengthwise direction of die steel bar so as to have a thickness of 20 mm, and was further cooled to room temperature by air-cooling (being left in the air). Thereafter, the steel bar is subjected to cutting work to be used as a specimen having a shape corresponding to a large end portion of the conrod. In the specimen, as illustrated in FIG. 1, a hole having a diameter of 50 mm was bored in the center portion having a plate shape having dimensions of 80 mm×80 mm and a thickness of 18 mm, and 45-degree V notches having a depth of 1 mm and a tip curvature of 0.5 mm were formed on the inner surface of the hole having a diameter of 50 mm at two points positioned at ±90 degrees with respect to the lengthwise direction of the steel bar which is a material before forging. Furthermore, through-holes having a diameter of 8 mm as bolt holes were made to be positioned at points where the center lines thereof were positioned at 8 mm from the side surfaces where the notch was formed.

A fracture splitting apparatus is constructed from a separated die and a drop-weight tester. The separated die has a shape in which a column having a diameter of 46.5 mm and formed on a rectangular steel is divided into two parts along the center line thereof. One divided part of the column is fixed, and the other divided part moves on a rail. Wedge holes are formed in joint surfaces of the two semicircular columns. In order to fracture the specimen, the column having a diameter of 46.5 mm of the separated die is fitted into the hole having a diameter of 50 mm of the specimen, a wedge is inserted therebetween, and installed on a drop-weight. The drop-weight has a mass of 200 kg, and has a mechanism of falling along a guide. When the drop-weight falls, the wedge is stuck, and the specimen is tensile fractured into two parts. In addition, so as not to cause the specimen to be separated from the separated die at the time of the fracture, the periphery of the specimen is fixed to be pressed by the separated die.

In this test, after the specimen is fractured under a drop-weight height of 100 mm, an operation of facing and fastening the fractured surfaces with a bolt under a torque of 20 N·m to be assembled with each other and an operation of unfastening the bolt to release the fractured surfaces are repeated ten times, and the total weight of fragments generated at the operations is defined as an amount of chip generation of the fractured surface.

Figure 2:
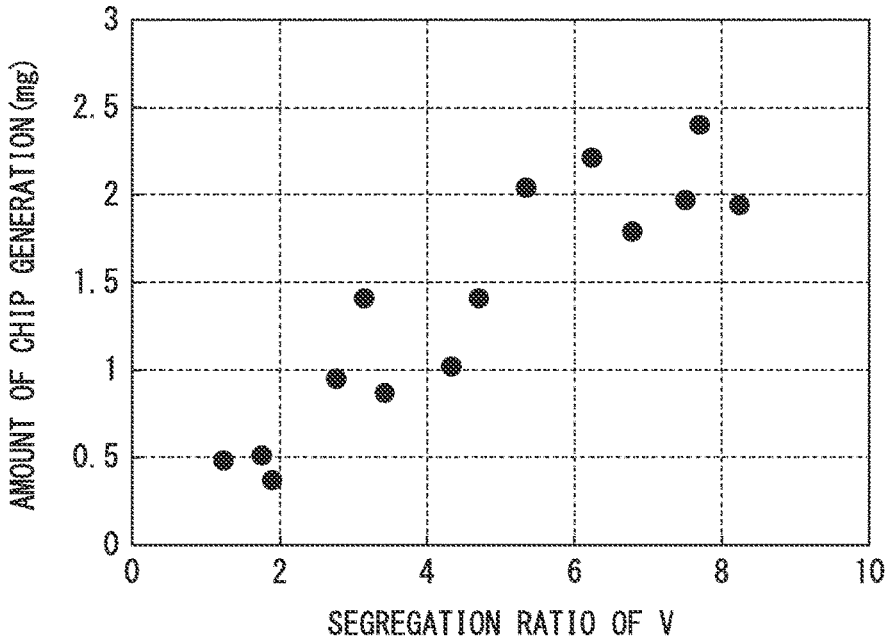
FIG. 2 is a diagram illustrating the relationship between a segregation ratio of V and an amount of chip generation in a fractured surface.

FIG. 2 illustrates the relationship between the segregation ratio of V and the amount of chip generation of the fractured surface. The amount of chip generation of the fractured surface is reduced due to the reduction in the segregation ratio of V. In order to suppress the amount of chip generation to be 1.0 mg or less for the purpose of omitting a process of eliminating the chips, the segregation ratio of V needs to be less than 3.0. Therefore, the upper limit of the segregation ratio of V was set to be less than 3.0. In order to further suppress the amount of chip generation, the segregation ratio of V is preferably 2.5 or less, and more preferably 2.0 or less.

As described above, control of the segregation ratio of V can be realized by adjusting whether or not to perform the electromagnetic stirring in the die during continuous casting, the degree of superheating molten steel in the tundish, and the rolling reduction gradient during light rolling reduction of the final solidification portion. When the electromagnetic stirring is performed, the degree of superheating molten steel in the tundish is 13° C. or higher and 40° C. or less, and the rolling reduction gradient during the light rolling reduction of the final solidification portion is 0.5 mm/m or higher and 2.0 mm/m or less, the segregation ratio of V can be 1.0 or higher and less than 3.0.

Examples of the present invention will be described below in detail. In addition, the examples are for explaining the technical meaning and effects of the present invention and do not limit the scope of the present invention.

Examples

A bloom was produced by continuous casting of a steel having a composition shown in Table 1 and melting in a converter. The bloom was subjected to blooming to be formed into a billet of 162 mm square, and then was subjected to hot rolling to be formed into a steel bar shape having a diameter of 56 mm. The symbol "–" in the table represents that the amount of the element associated with the position with the symbol is equal to or less than its detection limit vale. Furthermore, steel products were prepared in which the segregation ratios of V thereof are varied by adjusting whether or not to perform electromagnetic stirring in a die during continuous casting, a degree of superheating molten steel in a tundish, and a rolling reduction gradient during light rolling reduction of a final solidification portion as shown in Table 2. When the electromagnetic stirring was performed, the stirring was performed under a flow rate of 65 cm/sec. In addition, the steel was poured into the die in a range of the degree of superheating molten steel in a tundish of 13 to 52° C., and the rolling reduction was performed thereon in a range of the rolling reduction gradient during light rolling reduction of a final solidification portion of 0 to 1.4 mm/m. A heating temperature and a heating time for the bloom before the blooming were respectively 1270° C. and 140 min, and a heating temperature and a heating time for the billet before the hot rolling were respectively 1240° C. and 90 min. The underlined portion in the comparative steels of Table 1 represent that they are not in the range of the present invention.

[Table 1]

[Table 2]

Next, in order to examine the degree of segregation of V, by using the electron probe microanalyzer (EPMA), line analysis was performed on a cross-section perpendicular to a hot rolling direction of the steel bar having a diameter of 56 mm in a radial direction from the surface to the center and from the center to the surface, the V content distribution was measured, and the segregation ratio which is the ratio of the maximum value to the average value of the V content was calculated.

Subsequently, in order to examine fracture separability and mechanical properties (tensile property), the specimen corresponding to the forged conrod was produced by hot forging. Specifically, an element steel bar having a diameter of 56 mm and a length of 100 mm was heated to 1150 to 1280° C., was thereafter forged in a direction perpendicular to the lengthwise direction of the steel bar so as to have a thickness of 20 mm, and were further cooled to room temperature by air-cooling (being left in the air). A JIS No. 4 tensile specimen and a specimen for fracture separability evaluation having a shape corresponding to the large end portion of the conrod were cut from the forged material after the cooling. The JIS No. 4 tensile specimen was collected along the longitudinal direction at a position of 30 mm from the side surface of the forged material. In the specimen used in a fracture separability evaluation, as illustrated in FIG. 1, a hole having a diameter of 50 mm was bored in the center portion having a plate shape having dimensions of 80 mm×80 mm and a thickness of 18 mm, and 45-degree V notches having a depth of 1 mm and a tip curvature of 0.5 mm were formed on the inner surface of the hole having a diameter of 50 mm at two points positioned at ±90 degrees with respect to the lengthwise direction of the steel bar which is a material before the forging. Furthermore, through-holes having a diameter of 8 mm as the bolt holes were made to be positioned at points where the center lines thereof were positioned at 8 mm from the side surfaces where the notch was formed.

A testing machine for the fracture separability evaluation is constituted by a separated die and a drop-weight tester. The separated die has a shape in which a column having a diameter of 46.5 mm and formed on a rectangular steel is divided into two parts along the center line thereof. One divided part is fixed, and the other divided part moves on a rail. Wedge holes are formed in joint surfaces of the two semicircular columns. During the fracture test, the column having a diameter of 46.5 mm of the separated die is fitted into the hole having a diameter of 50 mm of the specimen, a wedge is inserted therebetween and installed on a drop-weight. The drop-weight has a mass of 200 kg, and has a mechanism of falling along a guide. When the drop-weight falls, the wedge is stuck, and the specimen is tensile fractured into two parts. In addition, so as not to cause the specimen to be separated from the separated die at the time of the fracture, the periphery of the specimen is fixed to be pressed by the separated die.

In this test, the fracture was performed under a drop-weight height of 100 mm, the specimens after the fracture were allowed to face each other and fastened by a bolt, and the difference between the inner diameter in a fracture direction and the inner diameter in a direction perpendicular to the fracture direction was measured and was defined as the amount of deformation by the fracture splitting. Thereafter, an operation of facing and fastening the fractured surfaces with a bolt at a torque of 20 N·m to be assembled with each other and an operation of unfastening the bolt to release the fractured surfaces are repeated ten times, and the total weight of fragments generated at the operations is defined as an amount of chip generation of the fractured surface. Regarding the fracture separability, the specimen having an amount of deformation by the fracture splitting of higher than 100 μm or having an amount of chip generation of the fractured surface of higher than 1.0 mg was regarded as not reaching the target.

In addition, regarding a yield ratio, the specimen having a yield ratio of less than 0.70 was regarded as not reaching the target. Regarding an elongation, the specimen having an elongation of higher than 18% was regarded as not reaching the target.

It was seen that all of Invention Examples of test Nos. 1 to 22 achieve the targets and have excellent fracture separability. On the other hand, the amounts of C, Si, Mn, P, and V in test Nos. 23 to 26, 28, and 30 were not in the range of the present invention. Therefore, in test Nos. 23 to 26, 28, and 30, the ferrite fractions were high or the ductility of the ferrite and pearlite structures was not sufficiently reduced and resulted in high ductility, and thus the amount of deformation during the fracture splitting was high and fracture separability was poor. The amounts of Mn and Cr in test Nos. 27 and 31 were not in the range of the present invention. Therefore, in test Nos. 27 and 31, a bainite structure is generated or the ductility of the pearlite structure was not sufficiently reduced, and thus the amount of deformation during the fracture splitting was high and the fracture separability was poor. The amount of S in test No. 29 was not in the range of the present invention. Therefore, in test No. 29, the amount of Mn sulfides having a high aspect ratio was increased such that separation had occurred, which results in cracks parallel to the extension direction of the Mn sulfides. Accordingly, in test No. 29, the amount of deformation during the fracture splitting was high and fracture separability was poor. In test Nos. 32 to 38, although the steel compositions of the steel were in the range of the present invention, electromagnetic stirring in the die during the continuous casting was not performed, the degree of superheating molten steel in a tundish was above 40° C., or the condition during light rolling reduction of a final solidification portion was not in the specified range. Therefore, in test Nos. 32 to 38, the segregation ratio of V was 3.0 or higher, and the amount of chip generation of the fractured surface had not reached the target.

INDUSTRIAL APPLICABILITY

The non-heat treated steel of the present invention has excellent fracture separability in which an amount of plastic deformation in the vicinity of a fractured surface is small and chips of the fractured surface are small when the non-heat treated steel is hot forged, air-cooled or forced-air-cooled, and then fracture split. Due to the characteristics in which the amount of plastic deformation of the fractured surface is small and furthermore chips are small, the fractured surfaces can be engaged with each other with good accuracy without misalignment in position during the engagement between the fractured surfaces, thereby increasing yield in production of parts. In addition, due to the characteristics, a process of eliminating the chips can be omitted, which results in a reduction in manufacturing cost. This is extremely effective in the industry.

DESCRIPTION OF REFERENCE NUMERALS AND SIGNS

1: SPECIMEN
2: HOLE
3: V NOTCH
4: THROUGH-HOLE

TABLE 1

| TEST No. | CLASSIFICATION | C | Si | Mn | P | S | V | N | Ca | Mg | Zr | Cr | Ti | Nb |
|---|---|---|---|---|---|---|---|---|---|---|---|---|---|---|
| 1 | INVEN- | 0.22 | 0.89 | 0.81 | 0.042 | 0.076 | 0.28 | 0.0107 | — | — | — | — | — | — |
| 2 | TION | 0.58 | 1.97 | 0.22 | 0.039 | 0.085 | 0.26 | 0.0099 | — | — | — | — | — | — |
| 3 | EXAMPLE | 0.40 | 0.53 | 0.76 | 0.038 | 0.075 | 0.26 | 0.0023 | — | — | — | — | — | — |
| 4 | | 0.43 | 0.88 | 1.98 | 0.043 | 0.078 | 0.26 | 0.0189 | — | — | — | — | — | — |
| 5 | | 0.42 | 0.88 | 0.81 | 0.039 | 0.077 | 0.12 | 0.0095 | — | — | — | — | — | — |
| 6 | | 0.44 | 0.94 | 0.83 | 0.043 | 0.076 | 0.50 | 0.0112 | — | — | — | — | — | — |
| 7 | | 0.42 | 0.91 | 0.82 | 0.039 | 0.140 | 0.28 | 0.0098 | — | — | — | — | — | — |
| 8 | | 0.38 | 0.90 | 0.77 | 0.150 | 0.076 | 0.25 | 0.0091 | — | — | — | — | — | — |
| 9 | | 0.41 | 0.90 | 0.79 | 0.041 | 0.079 | 0.29 | 0.0089 | 0.0006 | — | 0.0018 | — | — | — |
| 10 | | 0.39 | 0.89 | 0.79 | 0.043 | 0.080 | 0.26 | 0.0091 | 0.0047 | — | — | — | — | — |
| 11 | | 0.40 | 0.85 | 0.80 | 0.042 | 0.084 | 0.25 | 0.0110 | 0.0016 | 0.0048 | — | — | — | |
| 12 | | 0.40 | 0.90 | 0.84 | 0.035 | 0.085 | 0.28 | 0.0112 | — | 0.0014 | 0.0045 | — | — | — |
| 13 | | 0.39 | 0.88 | 0.79 | 0.043 | 0.083 | 0.28 | 0.0120 | — | — | — | 0.24 | — | — |
| 14 | | 0.42 | 0.94 | 0.83 | 0.045 | 0.084 | 0.29 | 0.0113 | — | — | — | 0.02 | — | — |
| 15 | | 0.38 | 0.93 | 0.76 | 0.043 | 0.083 | 0.29 | 0.0107 | — | — | — | — | 0.098 | — |
| 16 | | 0.39 | 0.90 | 0.85 | 0.045 | 0.083 | 0.26 | 0.0087 | — | — | — | — | — | 0.047 |
| 17 | | 0.42 | 0.91 | 0.80 | 0.040 | 0.078 | 0.26 | 0.0106 | — | — | — | 0.12 | 0.010 | — |
| 18 | | 0.39 | 0.87 | 0.83 | 0.045 | 0.079 | 0.28 | 0.0105 | — | — | — | — | 0.012 | 0.008 |
| 19 | | 0.39 | 0.93 | 0.83 | 0.039 | 0.084 | 0.28 | 0.0098 | 0.0025 | — | — | 0.09 | — | 0.007 |
| 20 | | 0.42 | 0.89 | 0.82 | 0.042 | 0.077 | 0.30 | 0.0105 | — | 0.0047 | 0.0021 | — | 0.002 | — |
| 21 | | 0.44 | 0.90 | 0.78 | 0.044 | 0.080 | 0.28 | 0.0087 | — | — | — | — | — | — |
| 22 | | 0.39 | 0.93 | 0.75 | 0.038 | 0.077 | 0.27 | 0.0099 | — | — | — | — | — | — |
| 23 | COMPAR- | 0.18 | 0.88 | 0.79 | 0.045 | 0.080 | 0.28 | 0.0107 | 0.0021 | — | — | — | — | — |
| 24 | ATIVE | 0.44 | 0.47 | 0.83 | 0.040 | 0.078 | 0.30 | 0.0114 | — | — | — | — | — | — |
| 25 | EXAMPLE | 0.38 | 2.30 | 0.84 | 0.044 | 0.081 | 0.27 | 0.0114 | 0.0017 | — | 0.0018 | — | — | — |
| 26 | | 0.39 | 0.91 | 0.18 | 0.043 | 0.075 | 0.27 | 0.0114 | — | — | — | — | — | — |
| 27 | | 0.41 | 0.94 | 2.10 | 0.043 | 0.083 | 0.29 | 0.0102 | — | — | — | — | 0.011 | 0.007 |
| 28 | | 0.43 | 0.93 | 0.80 | 0.008 | 0.075 | 0.27 | 0.0112 | — | — | — | — | — | — |
| 29 | | 0.43 | 0.91 | 0.84 | 0.037 | 0.157 | 0.27 | 0.0099 | 0.0012 | 0.009 | — | — | — | — |
| 30 | | 0.44 | 0.86 | 0.82 | 0.043 | 0.079 | 0.08 | 0.0106 | — | — | — | — | — | — |
| 31 | | 0.41 | 0.93 | 0.77 | 0.038 | 0.079 | 0.27 | 0.0107 | — | — | — | 0.26 | — | — |
| 32 | | 0.40 | 0.86 | 0.82 | 0.037 | 0.082 | 0.29 | 0.0103 | 0.035 | — | — | 0.07 | — | — |
| 33 | | 0.39 | 0.95 | 0.82 | 0.038 | 0.083 | 0.26 | 0.0096 | 0.013 | 0.0021 | — | — | — | — |
| 34 | | 0.42 | 0.91 | 0.79 | 0.038 | 0.080 | 0.26 | 0.0099 | — | — | — | — | — | — |
| 35 | | 0.40 | 0.88 | 0.81 | 0.043 | 0.082 | 0.28 | 0.0109 | — | — | 0.0021 | — | — | 0.010 |
| 36 | | 0.38 | 0.92 | 0.83 | 0.042 | 0.083 | 0.28 | 0.0100 | 0.0011 | — | — | 0.07 | 0.021 | — |
| 37 | | 0.40 | 0.91 | 0.83 | 0.045 | 0.079 | 0.28 | 0.0111 | — | — | — | 0.09 | — | — |
| 38 | | 0.39 | 0.89 | 0.85 | 0.042 | 0.077 | 0.27 | 0.0087 | — | — | — | — | — | — |

* THE UNDERLINED PARTS ARE UNDER CONDITIONS OUT OF THE RANGE OF THE PRESENT INVENTION.

TABLE 2

| TEST No. | CLASSIFICATION | PERFORMING OF ELECTROMAGNETIC STIRRING | DEGREE OF SUPERHEATING MOLTEN STEEL IN TUNDISH (° C.) | ROLLING REDUCTION GRADIENT DURING LIGHT ROLLING (mm/m) | SEGREGATION RATIO OF V | FRACTURE SEPARABILITY: AMOUNT OF DEFORMATION (μm) | FRACTURE SEPARABILITY: AMOUNT OF CHIP GENERATION (mg) | TENSILE PROPERTIES: YIELD STRENGTH (MPa) | TENSILE PROPERTIES: TENSILE STRENGTH (MPa) | TENSILE PROPERTIES: YIELD RATIO | TENSILE PROPERTIES: ELONGATION (%) |
|---|---|---|---|---|---|---|---|---|---|---|---|
| 1 | INVENTION EXAMPLE | YES | 15 | 1.1 | 2.0 | 81 | 0.68 | 687 | 832 | 0.83 | 16 |
| 2 | | YES | 18 | 0.6 | 1.1 | 74 | 0.48 | 667 | 943 | 0.71 | 14 |
| 3 | | YES | 14 | 1.3 | 1.8 | 72 | 0.61 | 713 | 976 | 0.73 | 14 |
| 4 | | YES | 14 | 1.4 | 1.7 | 45 | 0.61 | 895 | 1109 | 0.81 | 12 |
| 5 | | YES | 14 | 0.9 | 1.5 | 64 | 0.42 | 598 | 858 | 0.70 | 16 |
| 6 | | YES | 21 | 1.0 | 2.0 | 69 | 0.70 | 910 | 1121 | 0.81 | 12 |
| 7 | | YES | 13 | 1.1 | 1.9 | 57 | 0.70 | 727 | 966 | 0.75 | 14 |
| 8 | | YES | 20 | 1.0 | 1.8 | 76 | 0.62 | 694 | 919 | 0.76 | 15 |
| 9 | | YES | 22 | 1.1 | 1.6 | 65 | 0.58 | 736 | 972 | 0.76 | 14 |
| 10 | | YES | 17 | 1.1 | 1.9 | 49 | 0.58 | 706 | 935 | 0.75 | 15 |
| 11 | | YES | 21 | 1.3 | 1.6 | 54 | 0.56 | 696 | 922 | 0.75 | 15 |
| 12 | | YES | 19 | 1.1 | 1.8 | 54 | 0.57 | 725 | 946 | 0.77 | 14 |
| 13 | | YES | 14 | 1.0 | 1.8 | 73 | 0.52 | 718 | 936 | 0.77 | 15 |
| 14 | | YES | 15 | 1.0 | 2.0 | 68 | 0.54 | 737 | 965 | 0.76 | 14 |
| 15 | | YES | 13 | 1.0 | 1.6 | 57 | 0.43 | 911 | 1123 | 0.81 | 9 |
| 16 | | YES | 16 | 1.0 | 1.6 | 58 | 0.46 | 718 | 949 | 0.76 | 14 |
| 17 | | YES | 19 | 1.4 | 2.0 | 51 | 0.64 | 624 | 861 | 0.72 | 14 |
| 18 | | YES | 13 | 1.1 | 1.6 | 70 | 0.52 | 647 | 871 | 0.74 | 14 |
| 19 | | YES | 14 | 1.3 | 1.6 | 73 | 0.53 | 723 | 946 | 0.76 | 15 |
| 20 | | YES | 17 | 1.2 | 1.8 | 63 | 0.66 | 633 | 867 | 0.73 | 15 |
| 21 | | YES | 37 | 1.1 | 2.6 | 64 | 0.84 | 701 | 926 | 0.76 | 15 |
| 22 | | YES | 14 | 1.9 | 2.9 | 53 | 0.91 | 717 | 939 | 0.76 | 14 |
| 23 | COMPARATIVE EXAMPLE | YES | 17 | 1.1 | 1.6 | 145 | 0.40 | 681 | 808 | 0.84 | 21 |
| 24 | | YES | 22 | 1.1 | 1.9 | 113 | 0.38 | 745 | 981 | 0.76 | 24 |
| 25 | | YES | 20 | 1.2 | 1.8 | 157 | 0.28 | 661 | 810 | 0.82 | 21 |
| 26 | | YES | 22 | 1.0 | 1.7 | 212 | 0.45 | 604 | 814 | 0.74 | 27 |
| 27 | | YES | 19 | 1.2 | 1.9 | 267 | 0.35 | 879 | 1121 | 0.78 | 29 |
| 28 | | YES | 13 | 1.3 | 1.7 | 107 | 0.28 | 718 | 956 | 0.75 | 19 |
| 29 | | YES | 15 | 1.2 | 2.0 | 340 | 0.53 | 726 | 968 | 0.75 | 14 |
| 30 | | YES | 20 | 1.0 | 1.4 | 198 | 0.35 | 569 | 839 | 0.68 | 31 |
| 31 | | YES | 22 | 1.2 | 1.8 | 159 | 0.44 | 709 | 939 | 0.76 | 28 |
| 32 | | YES | 41 | 2.8 | 7.6 | 71 | 2.25 | 732 | 956 | 0.76 | 14 |
| 33 | | NO | 52 | 0.0 | 8.2 | 74 | 2.61 | 709 | 935 | 0.76 | 15 |
| 34 | | YES | 15 | 0.0 | 5.1 | 58 | 1.98 | 705 | 944 | 0.75 | 14 |
| 35 | | NO | 23 | 3.0 | 7.3 | 75 | 2.19 | 719 | 942 | 0.76 | 15 |
| 36 | | NO | 18 | 1.1 | 3.3 | 48 | 1.45 | 733 | 965 | 0.76 | 14 |
| 37 | | YES | 42 | 1.1 | 4.4 | 75 | 1.55 | 708 | 927 | 0.76 | 15 |
| 38 | | YES | 21 | 2.4 | 6.1 | 69 | 1.98 | 698 | 934 | 0.75 | 15 |

* THE UNDERLINED PARTS ARE UNDER CONDITIONS OUT OF THE RANGE OF THE PRESENT INVENTION.

The invention claimed is:

1. A non-heat treated steel comprising, as steel composition, by mass %,

C: 0.20 to 0.60%,
Si: 0.50 to 2.0%,
Mn: 0.20 to 2.0%,
P: 0.010 to 0.15%,
S: 0.010 to 0.15%,
V: 0.25 to 0.50%,
N: 0.002 to 0.02%, and
a balance comprising Fe and impurities,
wherein a ratio of a maximum value of a V content in the steel to an average value of the V content in the steel in a cross section of the steel is defined as a segregation ratio of V,
wherein the segregation ratio of V is 1.0 or more and less than 3.0, and
wherein the non-heat treated steel is used with fracture splitting.

2. The non-heat treated steel according to claim 1, further comprising at least one selected from the group consisting of, by mass %, Ca: 0.005% or less,
Mg: 0.005% or less, and
Zr: 0.005% or less.

3. The non-heat treated steel according to claim 1, further comprising at least one selected from the group consisting of, by mass %, Cr: 0.25% or less,
Ti: 0.10% or less, and
Nb: 0.05% or less.

4. The non-heat treated steel according to claim 2, further comprising at least one selected from the group consisting of, by mass %, Cr: 0.25% or less,
Ti: 0.10% or less, and
Nb: 0.05% or less.

5. The non-heat treated steel according to claim 1, wherein the upper limit of the amount of C is 0.50 mass %.

6. The non-heat treated steel according to claim 1, further comprising at least one selected from the group consisting of, by mass %, Mg: 0.0005 to 0.005%,
Zr: 0.0005 to 0.005%, and
Cr: 0.01 to 0.25%.

* * * * *